US006436623B1

(12) United States Patent
Hagemann et al.

(10) Patent No.: US 6,436,623 B1
(45) **Date of Patent: *Aug. 20, 2002**

(54) COLOR PHOTOGRAPHIC SILVER HALIDE MATERIAL

(75) Inventors: Jörg Hagemann, Köln; Jan Haller, Leverkusen; Günter Helling, Odenthal, all of (DE)

(73) Assignee: Agfa-Gevaert (BE)

( * ) Notice: Subject to any disclaimer, the term of this patent is extended or adjusted under 35 U.S.C. 154(b) by 0 days.

This patent is subject to a terminal disclaimer.

(21) Appl. No.: 10/016,311

(22) Filed: Oct. 31, 2001

Related U.S. Application Data

(62) Division of application No. 09/734,634, filed on Dec. 12, 2000, now Pat. No. 6,383,728.

(30) Foreign Application Priority Data

Dec. 17, 1999 (DE) ..... 199 60 899

(51) Int. Cl.[7] ..... G03C 1/08; G03C 7/26; G03C 7/32

(52) U.S. Cl. ..... 430/553; 430/552; 430/543; 430/551; 430/502; 430/558

(58) Field of Search ..... 430/543, 552, 430/553, 558, 551, 502

(56) References Cited

U.S. PATENT DOCUMENTS

| | | | | | |
|---|---|---|---|---|---|
| 4,775,616 | A | | 10/1988 | Kilminster et al. | 430/552 |
| 4,923,791 | A | | 5/1990 | Merkel et al. | 430/553 |
| 5,008,180 | A | | 4/1991 | Merkel et al. | 430/552 |
| 5,686,235 | A | | 11/1997 | Lau et al. | 430/553 |
| 5,888,716 | A | * | 3/1999 | Edwards et al. | 430/553 |
| 5,962,198 | A | * | 10/1999 | Lau et al. | 430/385 |
| 5,981,160 | A | | 11/1999 | Odenwäkder et al. | 430/551 |
| 6,180,331 | B1 | * | 1/2001 | Begley et al. | 430/553 |
| 6,190,850 | B1 | * | 2/2001 | Begley et al. | 430/553 |
| 6,190,851 | B1 | * | 2/2001 | Harder et al. | 430/553 |
| 6,190,852 | B1 | * | 2/2001 | Mura et al. | 430/553 |
| 6,194,132 | B1 | * | 2/2001 | Begley et al. | 430/553 |
| 6,197,490 | B1 | * | 3/2001 | Begley et al. | 430/553 |
| 6,197,491 | B1 | * | 3/2001 | Begley et al. | 430/553 |
| 6,197,492 | B1 | * | 3/2001 | Begley et al. | 430/553 |
| 6,207,363 | B1 | * | 3/2001 | Begley et al. | 430/553 |
| 6,251,575 | B1 | * | 6/2001 | Begley et al. | 430/553 |

FOREIGN PATENT DOCUMENTS

| | | |
|---|---|---|
| EP | 825 488 | 2/1998 |
| EP | 871 066 | 10/1998 |
| JP | 59-135465 | 8/1984 |

* cited by examiner

*Primary Examiner*—Geraldine Letscher
(74) *Attorney, Agent, or Firm*—Connolly Bove Lodge & Hutz LLP

(57) ABSTRACT

A colour photographic silver halide material having a support and at least one photo-sensitive silver halide emulsion layer which is associated with a cyan coupler of the formula (I):

(I)

in which $R_1$, $R_2$, $R_3$, $Z_1$, $Y_1$ and n have the meaning stated in the description, is distinguished by elevated dye stability of the dye produced from the coupler by chromogenic processing.

6 Claims, No Drawings

COLOR PHOTOGRAPHIC SILVER HALIDE MATERIAL

This application is a division of U.S. application Ser. No. 09/734,634, filed Dec. 12, 2000, now U.S. Pat. No. 6,383,728.

This invention relates to a colour photographic silver halide material having a novel cyan coupler.

It is known from JP-N 59 111 645, U.S. Pat. No. 5,008,180 and U.S. Pat. No. 5,686,235 to use 2,5-diacylaminophenols having a sulfonyl group as cyan couplers. However, the colour reproduction and dye stability of the dyes produced from the couplers by chromogenic processing do not meet requirements.

The object of the invention was to provide cyan couplers which are improved with regard to these properties. This object is achieved with the couplers described below.

The present invention accordingly provides a colour photographic silver halide material having a support and at least one photosensitive silver halide emulsion layer which is associated with a cyan coupler of the formula (I):

(I)

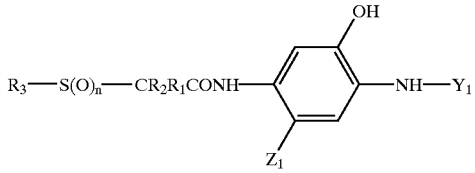

in which $R_1$, $R_2$mean H, alkyl, alkenyl, aryl or hetaryl, $R_3$ means alkyl, alkenyl, aryl or hetaryl, $Z_1$ means H or a group eliminable under the conditions of chromogenic development, $Y_1$ means —$COR_4$, —$CO_2R_4$, —$CONR_4R_5$, —$SO_2R_4$, —$SO_2NR_4R_5$, —CO—$CO_2R_4$, —$COCONR_4R_5$ or a group of the formula:

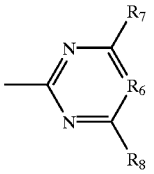

$R_4$ means alkyl, alkenyl, aryl or hetaryl, $R_5$ means H or $R_4$, $R_6$ means —N═or —C($R_9$)═

$R_7$, $R_8$, $R_9$ mean —$OR_5$, —$SR_5$, —$NR_4R_5$, —$R_5$ or Cl and n means 1 or 2.

Within the formula, the following groups of couplers are preferred:

(1) couplers in which n means 1 and $R_1$ to $R_9$, $Z_1$ and $Y_1$ have the stated meaning.

(2) couplers in which n means 2, $Y_1$ means —CO—$Y_{11}$ and $Y_{11}$ means alkenyl or hetaryl and $R_1$ to $R_3$ and $Z_1$ have the stated meaning.

(3) couplers in which n means 2, $Y_1$ means —$SO_2R_{10}$, —$SO_2N(R_{10})_2$, —$CO_2R_{10}$, —$COCO_2$—$R_{10}$ or —COCO—$N(R_{10})_2$ and $R_{10}$ means alkyl, aryl, alkenyl or hetaryl and $R_1$ to $R_3$ and $Z_1$ have the stated meaning.

(4) couplers in which n means 2, $Y_1$ means a residue of the formula:

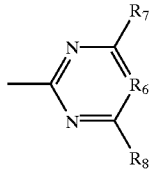

and $R_1$ to $R_3$, $R_6$ to $R_8$ and $Z_1$ have the stated meaning.

(5) couplers in which n means 2, $Y_1$ means a residue of the formula:

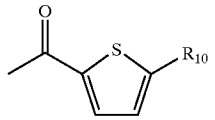

wherein $R_{10}$ means H, Cl, CN, Br, F, alkylcarbonyl, arylcarbonyl, alkylaminocarbonyl, arylaminocarbonyl, alkoxycarbonyl or aryloxycarbonyl and $R_1$ to $R_3$ and $Z_1$ have the stated meaning.

In the formula (I) and the compounds (1) to (4), the substituents have the following preferred meaning:

$R_1$, $R_2$H, alkyl, aryl, $R_3$ alkyl, aryl, $Z_1$ H, Cl, alkoxy, aryloxy, alkylthio, arylthio, $R_6$ —N═, $R_7$, $R_8$ —$OR_5$, —$NR_4R_5$, —Cl.

Very particularly preferably, $R_2$ means H and $R_4$ means alkyl or aryl.

Alkyl and alkenyl residues may be linear, branched or cyclic and in turn be substituted.

Aryl and hetaryl residues may in turn be substituted, wherein aryl is in particular phenyl.

Possible substituents for the alkyl, alkenyl, aryl or hetaryl residues are: alkyl, alkenyl, aryl, hetaryl, alkoxy, aryloxy, alkenyloxy, hydroxy, alkylthio, arylthio, halogen, cyano, acyl, acyloxy, acylamino, wherein an acyl residue may be derived from an aliphatic, olefinic or aromatic carbonic, carboxylic, carbamic, sulfonic, sulfonamido, sulfinic, phosphoric, phosphonic or phosphorous acid.

Examples of compounds according to the invention in which n=2 are:

| Nr. | $R_1$ | $R_2$ | $R_3$ | $Y_1$ | $Z_1$ |
|---|---|---|---|---|---|
| I-1 | $—C_2H_5$ | H | 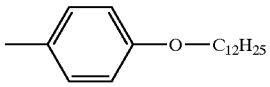 | 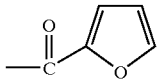 | —Cl |
| I-2 | $—C_2H_5$ | H | 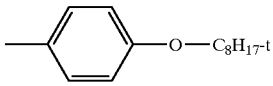 | 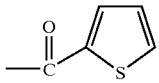 | —H |
| I-3 | $—C_6H_{13}$ | H | 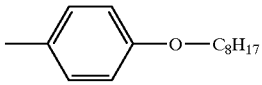 | 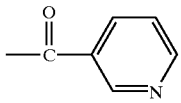 | $—OCH_2CH_2—$ $SCH_2COOH$ |
| I-4 | -phenyl | H | 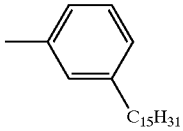 | 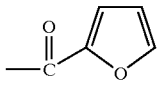 | —Cl |
| I-5 | $—CH_3$ | $—CH_3$ | $—C_{16}H_{33}$ | 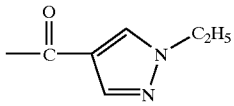 | —Cl |
| I-6 | -phenyl | H | $—C_{12}H_{27}$ | 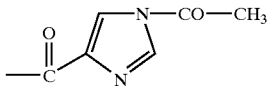 | $—SCH_2CH_2—$ COOH |
| I-7 | $—C_2H_5$ | H | 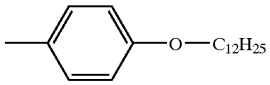 | 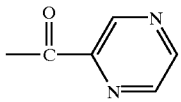 | $—O—CH_2—$ $COOCH_3$ |
| I-8 | $C_{12}H_{25}$ | H | 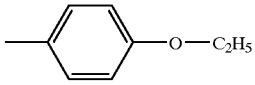 | 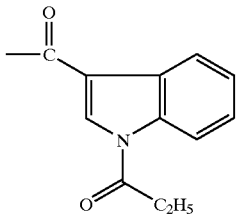 | —Cl |
| I-9 | $—C_3H_7$-i | H | 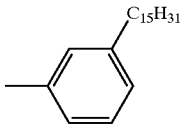 | 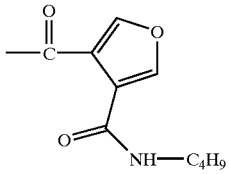 | —Cl |
| I-10 | $—CH_3$ | $—CH_3$ | 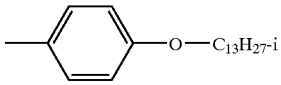 | 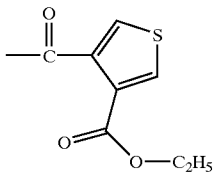 | 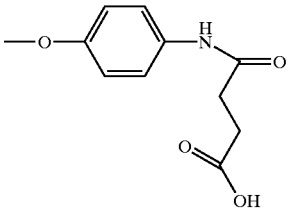 |
| I-11 | $—C_2H_5$ | H | 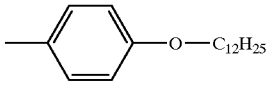 | 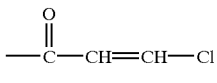 | —Cl |

-continued

| Nr. | $R_1$ | $R_2$ | $R_3$ | $Y_1$ | $Z_1$ |
|---|---|---|---|---|---|
| I-12 | -phenyl | H | $—C_{16}H_{33}$ | —C(=O)—CH=CH— | H |
| 1-13 | $—C_{12}H_{25}$ | H | | —C(=O)—CH=CH— $OCH_3$ | —Cl |
| 1-14 | $—C_4H_9$ | H | $C_{15}H_{31}$ | —C(=O)—CH=CH—CO—NH—$C_4H_9$-t | $—OCH_2COOCH_3$ |
| I-15 | $—CH_3$ | $—CH_3$ | O, O—$C_8H_{17}$ | —C(=O)—CH=CH—C(=O)—O—$H_5C_2$ | —Cl |
| 1-16 | $—C_2H_5$ | H | O—$C_{12}H_{25}$ | $—SO_2—C_4H_9$ | —Cl |
| 1-17 | $—C_2H_5$ | H | O—$C_{12}H_{25}$ | $—CO—O—C_4H_9$- | —Cl |
| 1-18 | $—C_3H_7$-i | H | $C_{15}H_{31}$ | —CO—CO—N($C_4H_9$)($C_4H_9$) | $—OCH_2—COOCH_3$ |
| I-19 | -phenyl | H | $—CH_2—CH(C_6H_{13})—C_8H_{17}$ | $—SO_2—NH—C_4H_9$-t | H |
| I-20 | $—C_6H_{13}$ | H | O—$C_8H_{17}$ | $—SO_2$— $CH_3$ | H |
| I-21 | $—CH_3$ | $—CH_3$ | O, O—$C_{12}H_{25}$ | $—CO—CO—OC_2H_5$ | —Cl |
| I-22 | $—C_4H_9$ | H | $C_{15}H_{31}$ | $—SO_2—CH_3$ | —Cl |
| I-23 | -phenyl | -phenyl | $—C_{12}H_{25}$ | $—SO_2—C_4H_9$ | $—SCH_2CH_2—COOH$ |
| I-24 | $—C_{12}H_{25}$ | H | O—$C_2H_5$ | $—CO—O—C_2H_5$ | —Cl |
| I-25 | $—C_2H_5$ | H | O—$C_{12}H_{25}$ | —CO—S—Cl | Cl |

-continued
| Nr. | $R_1$ | $R_2$ | $R_3$ | $Y_1$ | $Z_1$ |
|---|---|---|---|---|---|
| I-26 | $—CH_3$ | H | 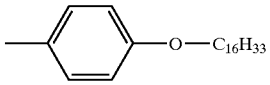 | 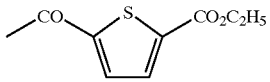 | Cl |
| I-27 | $—C_2H_5$ | H | 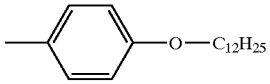 | 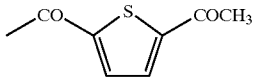 | Cl |
$Y_1$ = 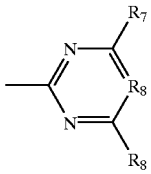
are:
| No. | $R_1$ | $R_2$ | $R_3$ | $R_7$ |
|---|---|---|---|---|
| I-28 | $—C_2H_5$ | H | 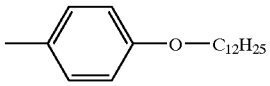 | $—N(C_4H_9)_2$ |
| I-29 | $—C_2H_5$ | H | 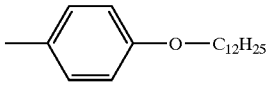 | 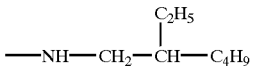 |
| I-30 | $—C_2H_5$ | H | 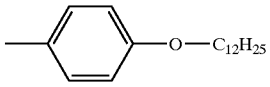 | $—OCH_3$ |
| I-31 | $—C_6H_{13}$ | H | 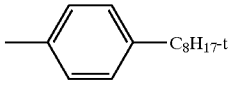 | —Cl |
| I-32 | -phenyl | H | $—C_{12}H_{25}$ | $—OCH_3$ |
| I-33 | $—CH_3$ | $—CH_3$ | 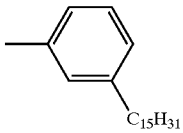 | $—NH—C_4H_9$ |
| I-34 | H | H | 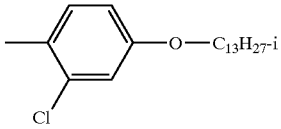 | $—OCH_3$ |
| I-35 | $—CH_3$ | H | 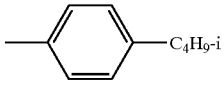 | —Cl |
| No. | $R_8$ | $R_6$ | $Z_1$ |
|---|---|---|---|
| I-28 | $—N(C_4H_9)_2$ | —N= | —C— |
| I-29 | 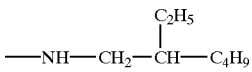 | —N= | —Cl |

-continued
$Y_1$ = 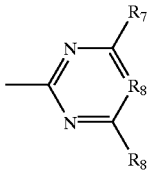
are:
| | | | |
|---|---|---|---|
| I-30 | —$OCH_3$ | —N= | —Cl |
| I-31 | —NH—$C_4H_9$ | —C(NH$C_4H_9$)= | H |
| I-32 | —N($C_4H_9$)$_2$ | —N= | —$OCH_2COOCH_3$ |
| I-33 | —NH—$C_4H_9$ | —C(N($C_2H_5$)$_2$)= | —Cl |
| I-34 | —NH—$C_4H_9$ | —N= | —S—$CH_2CH_2$—COOH |
| I-35 | —N—($CH_2$—CH($C_2H_5$)—$C_4H_9$)$_2$ | —N= | —Cl |
| No. | $R_1$ | $R_2$ | $R_3$ |
|---|---|---|---|
| I-36 | —$C_2H_5$ | H | 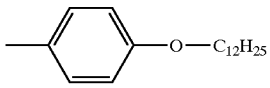 |
| I-37 | —$C_4H_9$ | H | 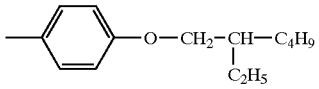 |
| I-38 | —$C_6H_{13}$ | H | 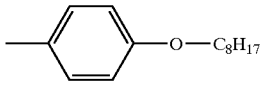 |
| I-39 | —$CH_3$ | —$CH_3$ | 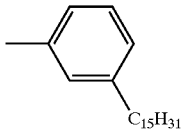 |
| I-40 | -phenyl | H | 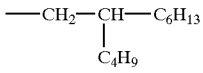 |
| I-41 | —$C_2H_5$ | H | 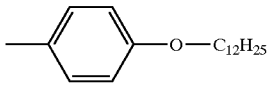 |
| I-42 | —$C_{12}H_{25}$ | H | 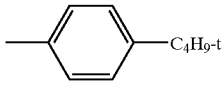 |
| I-43 | —$C_4H_9$ | H | —$C_{12}H_{25}$ |
| 1-44 | —$C_2H_5$ | H | 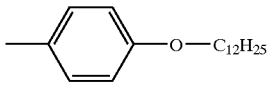 |
| 1-45 | —$C_3H_7$-i | H | —$C_{16}H_{33}$ |
-continued
| | | | |
|---|---|---|---|
| I-46 | —$CH_2CH_2CH_2CH_2$— | | 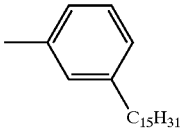 |
| I-47 | —$C_2H_5$ | —$C_2H_5$ | 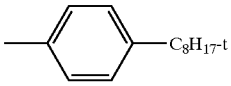 |
| I-48 | -phenyl | H | —$C_{12}H_{25}$ |
| I-49 | —$C_{12}H_{25}$ | H | 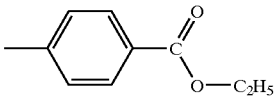 |
| I-50 | —$C_2H_5$ | H | 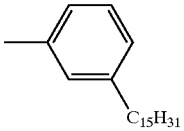 |
| I-51 | —$C_6H_{13}$ | H | 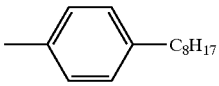 |
| I-52 | —$C_4H_9$ | H | 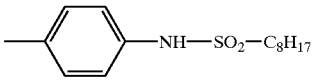 |
| I-53 | —$CH_3$ | H | 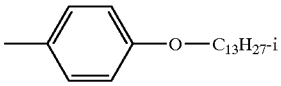 |
| I-54 | -phenyl | H | 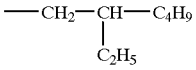 |

-continued
| | | | |
|---|---|---|---|
| I-55 | $—C_2H_5$ | H | 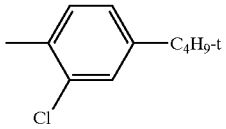 |
| I-56 | $—C_2H_5$ | H | 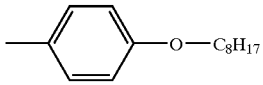 |
| I-57 | $—C_3H_7$ | H | 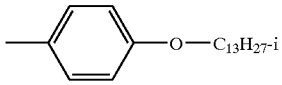 |
| I-58 | $—C_2H_5$ | H | 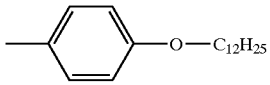 |
| I-59 | —H | H | 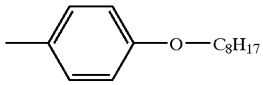 |
| I-60 | $—C_2H_5$ | H | 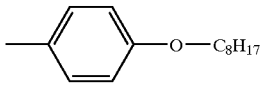 |
| No. | $Y_1$ | $Z_1$ |
|---|---|---|
| I-36 | 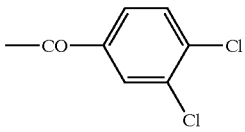 | —Cl |
| I-37 | $—CO—C_3F_7$ | —Cl |
| I-38 | 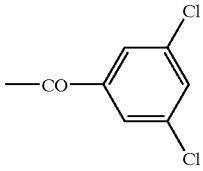 | $—OCH_2CH_2—S—CH_2COOH$ |
| I-39 | 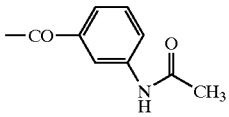 | H |
| I-40 | 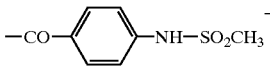 | —Cl |
| I-41 | 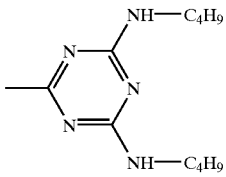 | H |
-continued
| | | |
|---|---|---|
| I-42 | 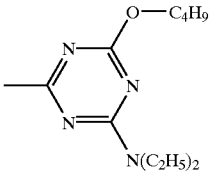 | 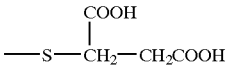 |
| I-43 | 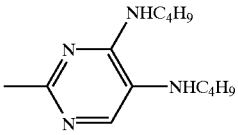 | —Cl |
| 1-44 | $—SO_2—C_4H_9$ | —Cl |
| 1-45 | 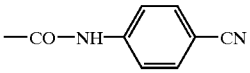 | $—O—CH_2—COO—CH_3$ |
| I-46 | 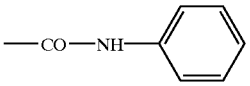 | —Cl |
| I-47 | $—CO—O—C_4H_9$-i | H |
| I-48 | $—CO—CO—N(C_4H_9)_2$ | 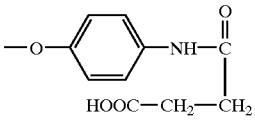 |
| I-49 | $—CO—CH=CH—CO—N(C_2H_5)_2$ | —Cl |
| I-50 | 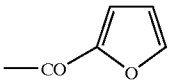 | —Cl |
| I-51 | 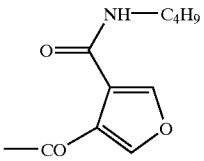 | H |
| I-52 | 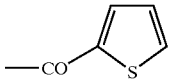 | —Cl |
| I-53 | 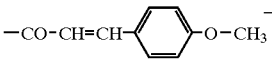 | —Cl |
| I-54 | 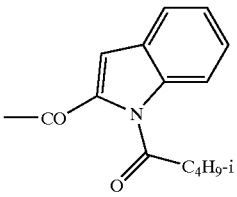 | H |
| I-55 | 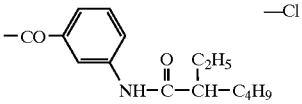 | —Cl |

-continued

| | | |
|---|---|---|
| I-56 | 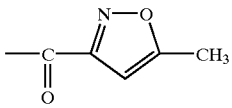 | Cl |
| I-57 | 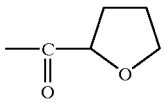 | Cl |
| I-58 | 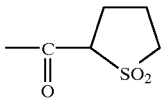 | H |
| I-59 | 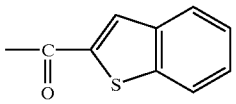 | Cl |
| I-60 | 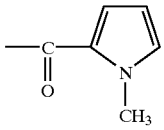 | Cl |

The compounds according to the invention are produced in an analogous manner to the method stated in U.S. Pat. No. 5,686,235.

The compounds of the formula (I) are preferably used in a quantity of 5 to 2000 mg/m$^2$, in particular of 10 to 1000 mg/m$^2$ and very particularly preferably in a quantity of 20 to 500 mg/m$^2$ of the material.

Examples of colour photographic materials are colour negative films, colour reversal films, colour positive films, colour photographic paper, colour reversal photographic paper, colour-sensitive materials for the dye diffusion transfer process or the silver dye bleaching process. A review may be found in Research Disclosure 37038 (1995) and Research Disclosure 38957 (1996).

The photographic materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627.

The colour photographic materials conventionally contain at least one red-sensitive, one green-sensitive and one blue-sensitive silver halide emulsion layer, optionally together with interlayers and protective layers.

Depending upon the type of photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sublayers are generally arranged closer to the support than the more highly sensitive sublayers.

A yellow filter layer is conventionally located between the green-sensitive and blue-sensitive layers which prevents blue light from penetrating into the underlying layers.

Possible options for different layer arrangements and the effects thereof on photographic properties are described in J. Inf. Rec. Mats., 1994, volume 22, pages 183–193 and in Research Disclosure 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 25 30 645).

The substantial constituents of the photographic emulsion layers are binder, silver halide grains and colour couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Photographic materials with camera sensitivity conventionally contain silver bromide-iodide emulsions, which may optionally contain small proportions of silver chloride. Photographic print materials contain either silver chloride-bromide emulsions containing up to 80 wt. % of AgBr or silver chloride-bromide emulsions containing above 95 mol % of AgCl.

Details of colour couplers may be found in Research Disclosure 37254, part 4 (1995), page 288, in Research Disclosure 37038, part II (1995), page 80 and in Research Disclosure 38957, part X.B (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290, in Research Disclosure 37038, part XIV (1995), page 86 and in Research Disclosure 38957, part X.C (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq.

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce colour fogging and to reduce yellowing, and others. Suitable compounds may be found in Research Disclosure 37254, part 8 (1995), page 292, in Research Disclosure 37038, parts IV, V, VI, VII, X, XI and XII (1995), pages 84 et seq. and in Research Disclosure 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, colour photographic materials are processed using different processes depending upon their nature. Details relating to processing methods and the necessary chemicals are disclosed in Research Disclosure 37254, part 10 (1995), page 294, in Research Disclosure 37038, parts XVI to XXII (1995), pages 95 et seq. and in Research Disclosure 38957, parts XVIII, XIX and XX (1996), pages 630 et seq. together with example materials.

The magenta couplers preferably comprise those having pyrazolotriazole structures of the formulae (II) or (III):

(II)

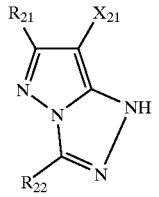

(III)

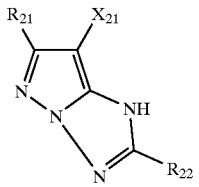

in which $X_{21}$ means H or a group eliminable under the conditions of chromogenic development, $R_{21}$ means optionally substituted alkyl, $R_{22}$ means $R_{21}$ or aryl, wherein the sum of all the C atoms of the residues $R_{21}$ and $R_{22}$ in one coupler molecule is at least 12.

Examples of suitable couplers are:

M-1

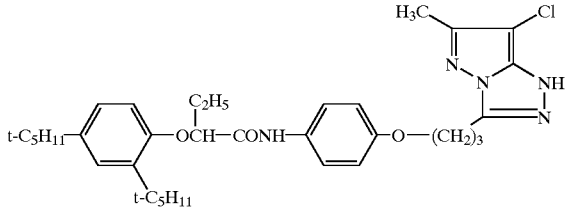

M-2

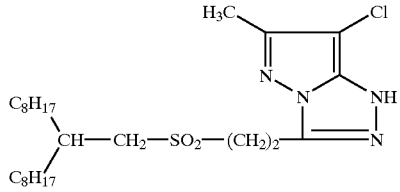

M-3

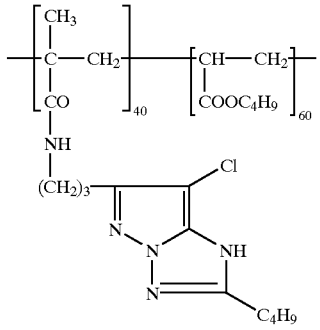

M-4

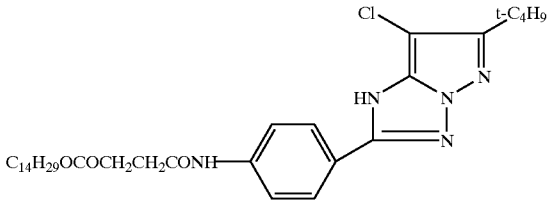

M-5

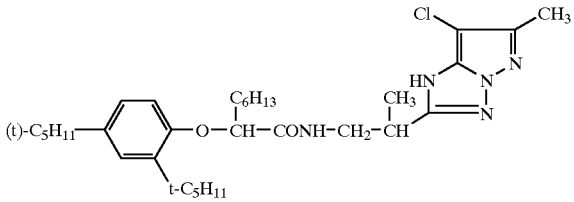

M-6

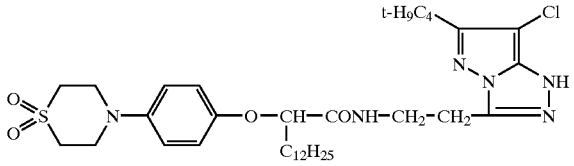

M-7

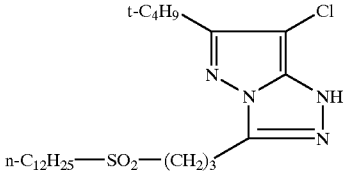

-continued
M-8
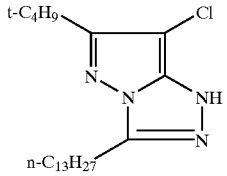
M-9
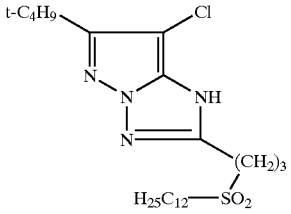
M-10
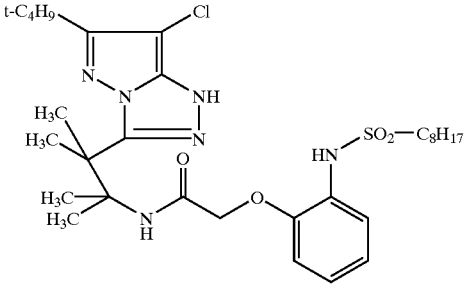
Apart from the cyan couplers of the formula (I) according to the invention, further cyan couplers may be used in the same or in another layer.
Examples of these are:
C-1
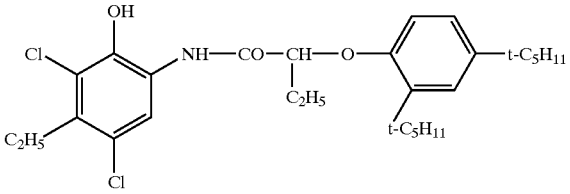
C-2
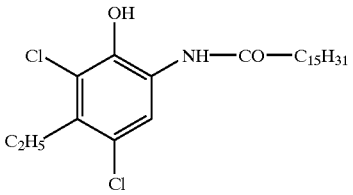
C-3
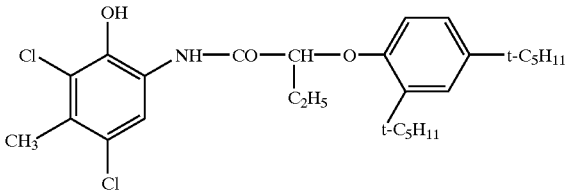
-continued
C-4
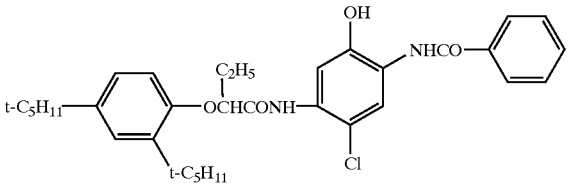
C-5
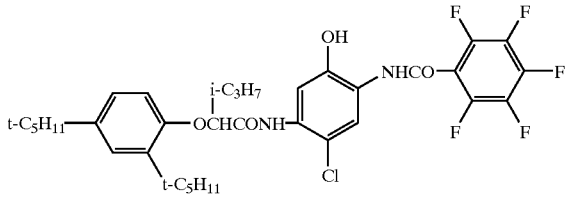
C-6
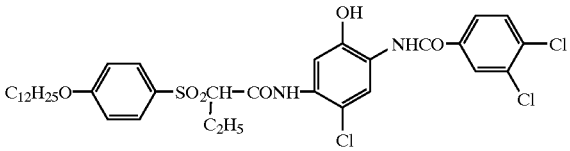
C-7
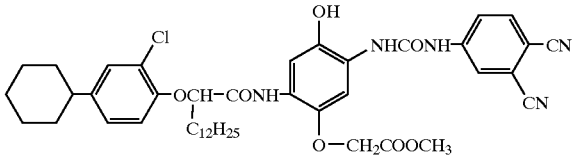
C-8
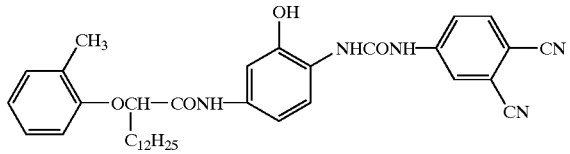
C-9
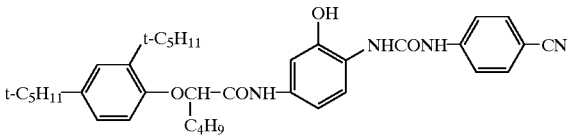
C-10
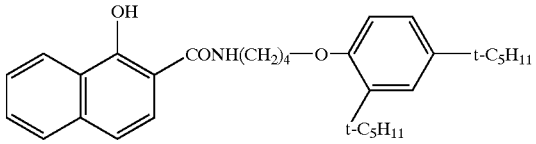
C-11
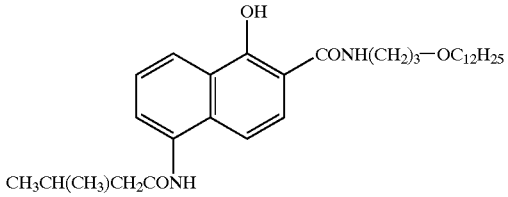

-continued

C-12

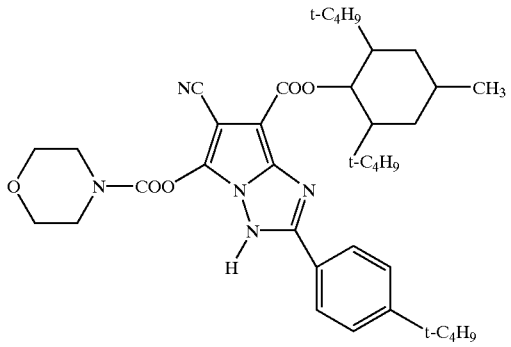

C-13

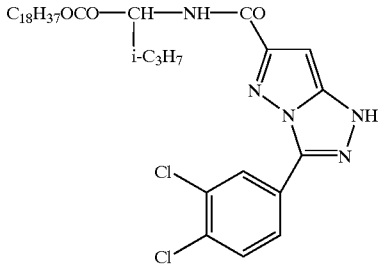

C-14

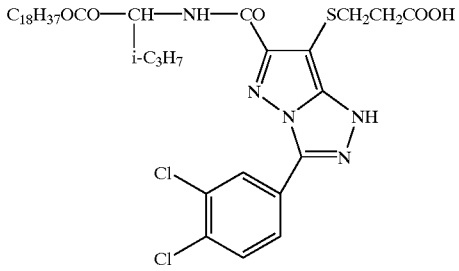

C-15

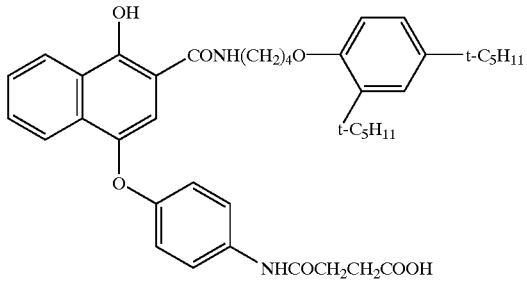

C-16

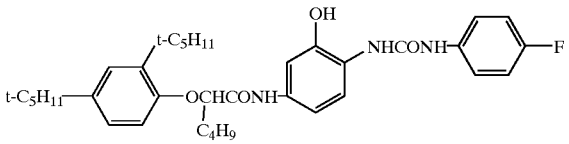

C-17

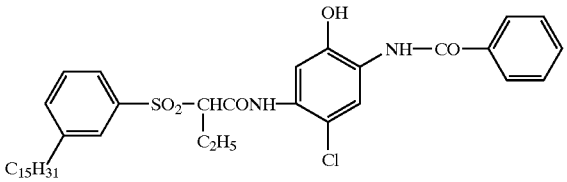

The DOP scavenger preferably comprises benzofuranones of the formula (IV):

(IV)

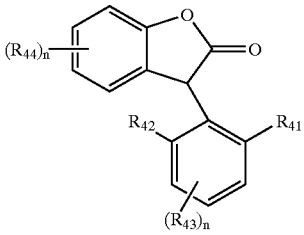

in which $R_{41}$ means alkyl, cycloalkyl, aryl, halogen, $SR_{45}$, $NR_{46}R_{47}$, nitro, cyano, $SO_2R_{48}$, $COOR_{49}$, $COR_{50}$, hetaryl or hydrogen, $R_{42}$ has the same meaning as $R_{41}$ or means $OR_{52}$, $R_{43}$ and $R_{44}$ mutually independently mean $OR_{51}$ or have the meaning of $R_{41}$, $R_{45}$, $R_{49}$ mutually independently mean alkyl, cycloalkyl, alkenyl, aryl or hetaryl, $R_{46}$, $R_{47}$ mutually independently mean H, $R_{44}$, $COR_{50}$, $COOR_{49}$, $SO_2R_{48}$, $R_{48}$, $R_{50}$ mutually independently mean alkyl, cycloalkyl, alkenyl, aryl, hetaryl or $NR_{40}R_{47}$, $R_{51}$ means hydrogen, alkyl or aryl, $R_{52}$ means hydrogen, alkyl, aryl, alkylcarbonyl, alkenylcarbonyl, arylcarbonyl, alkoxycarbonyl, alkenyloxyearbonyl, carbamoyl, alkysulfonyl or arylsulfonyl, o means 0, 1, 2, 3 or 4 and p means 0, 1, 2, or 3, wherein two residues $R_{43}$ or $R_{44}$ may in each case mean a fused carbo- or heterocyclic ring or the compound of the formula (IV) is attached to a polymer chain via a residue $R_{43}$ or $R_{44}$.

Examples of suitable compounds are:

S-1

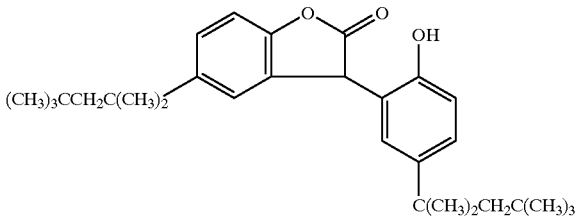

S-2

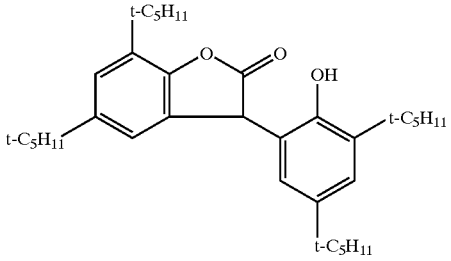

-continued

S-3

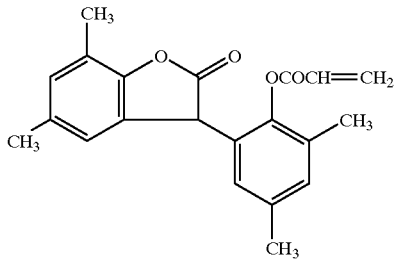

S-4

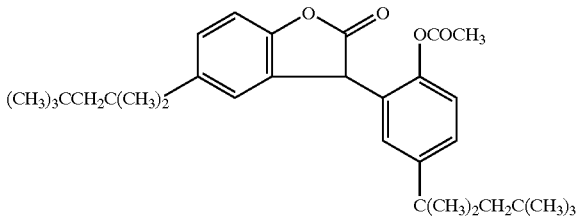

S-5

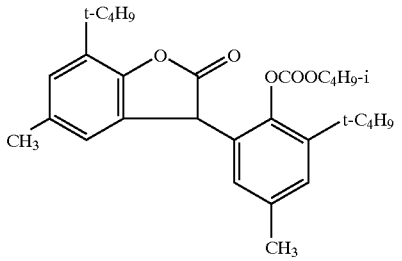

S-6

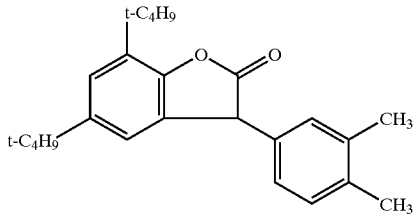

S-7

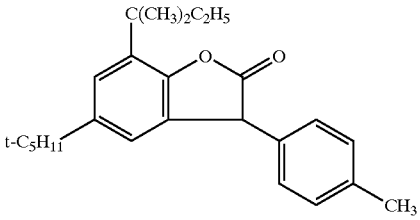

S-8

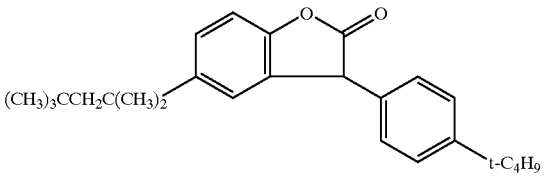

-continued

S-9

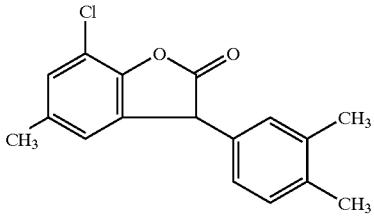

S-10

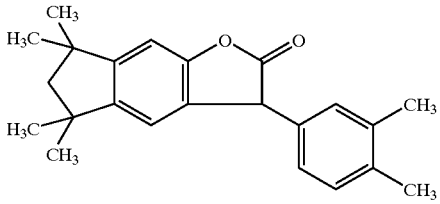

S-11

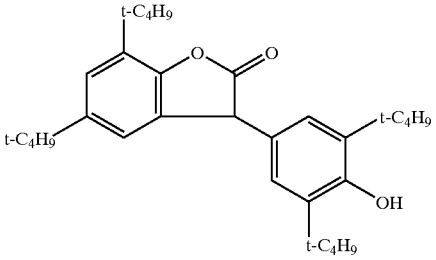

S-12

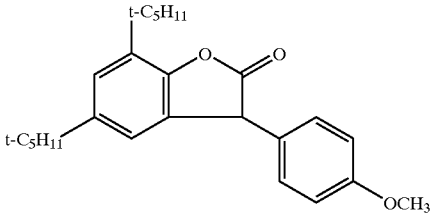

EXAMPLES

Example 1

A colour photographic recording material suitable for rapid processing was produced by applying the following layers in the stated sequence onto a layer support of paper coated on both sides with polyethylene. Quantities are stated in each case per 1 $m^2$. The silver halide application rate is stated as the corresponding quantities of $AgNO_3$.

Layer structure 101

Layer 1: (Substrate layer)
0.10 g of gelatine

Layer 2: (Blue-sensitive layer)
Blue-sensitive silver halide emulsion (99.5 mol % chloride, 0.5 mol % bromide, average grain diameter 0.75 $\mu$m) prepared from 0.4 g of $AgNO_3$, spectrally sensitised with 0.6 mg of compound BS-1

1.25 g of gelatine 0.30 g of yellow coupler GB-1

0.15 g of yellow coupler GB-2

0.30 g of tricresyl phosphate (TCP)
0.10 g of isooctadecanol
0.05 g of stabiliser ST-1
0.10 g of stabiliser ST-2

Layer 3: (Interlayer)
- 0.10 g of gelatine
- 0.08 g of DOP scavenger S-4
- 0.04 g of DOP scavenger SC-1
- 0.01 g of DOP scavenger SC-2
- 0.12 g of TCP Layer 4: (Green-sensitive layer)
- Green-sensitive silver halide emulsion (99.5 mol % chloride, 0.5 mol % bromide, average grain diameter 0.45 $\mu$m) prepared from 0.2 g of $AgNO_3$, spectrally sensitised with 0.12 mg of compound GS-1
- 1.10 g of gelatine
- 0.10 g of magenta coupler M-7
- 0.10 g of magenta coupler M-4
- 0.15 g of stabiliser ST-3
- 0.20 g of stabiliser ST-4
- 0.20 g of TCP
- 0.20 g of isotetradecanol
- 0.20 g of tris(2-ethylhexyl) phosphate Layer 5: (UV protective layer)
- 1.05 g of gelatine
- 0.20 g of UV absorber UV-1
- 0.10 g of UV absorber UV-2
- 0.05 g of UV absorber UV-3
- 0.08 g of DOP scavenger S-4
- 0.04 g of DOP scavenger SC-1
- 0.01 g of DOP scavenger SC-2
- 0.15 g of TCP
- 0.15 g of tris(2-ethylhexyl) phosphate Layer 6: (Red-sensitive layer)
- Red-sensitive silver halide emulsion (99.5 mol % chloride, 0.5 mol % bromide, average grain diameter 0.48 $\mu$m) prepared from 0.28 g of $AgNO_3$, spectrally sensitised with 0.04 mg of compound RS-1 and stabilised with 0.56 mg of stabiliser ST-5
- 1.00 g of gelatine
- 0.10 g of cyan coupler C-1
- 0.30 g of cyan coupler C-2
- 0.20 g of dibutyl phthalate (DBP)
- 0.20 g of TCP
- 0.10 g of stabiliser ST-6

Layer 7: (UV protective layer)
- 1.05 g of gelatine
- 0.10 g of UV absorber UV-1
- 0.30 g of UV absorber UV-2
- 0.05 g of UV absorber UV-3
- 0.20 g of tris(2-ethylhexyl) phosphate Layer 8: (Protective layer)
- 0.90 g of gelatine
- 0.05 g of optical brightener W-1
- 0.07 g of polyvinylpyrrolidone
- 1.20 mg of silicone oil
- 2.50 mg of polymethyl methacrylate spacers, average particle size 0.8 $\mu$m
- 0.30 g of instant hardener H-1

The following compounds are used in Example 1:

GB-1

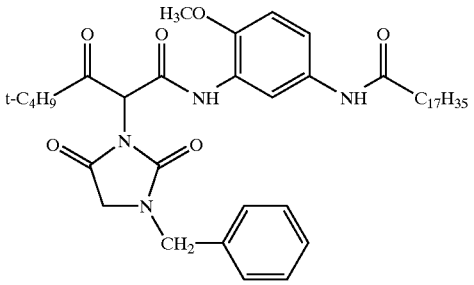

GB-2

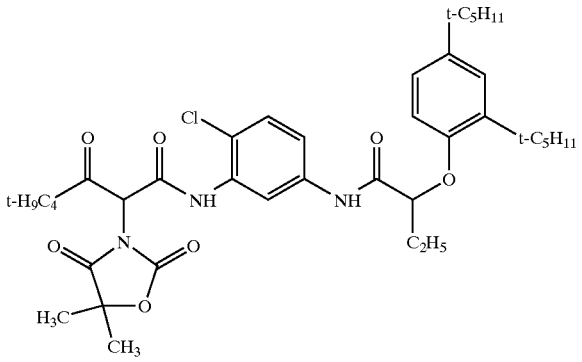

SC-1

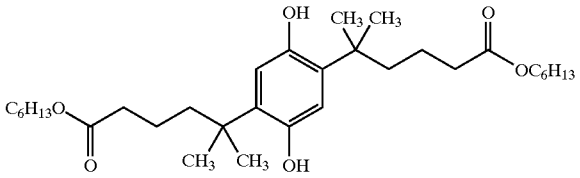

SC-2

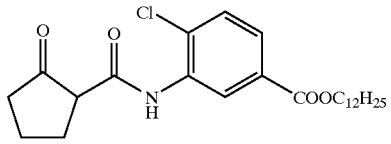

-continued
UV-1
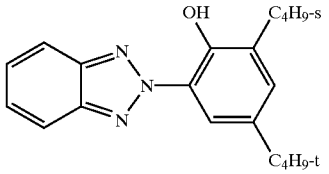
UV-2
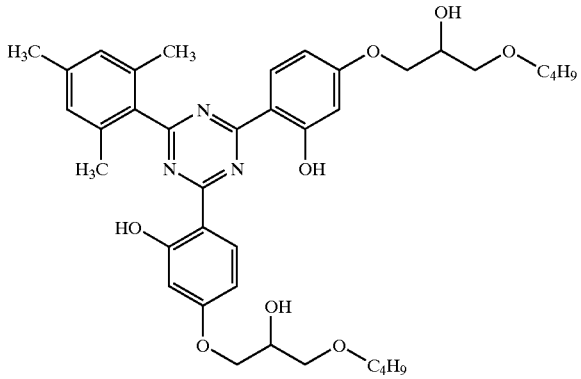
UV-3
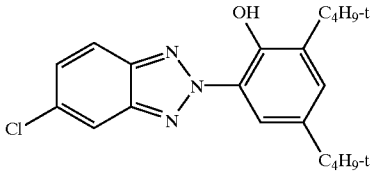
H-1
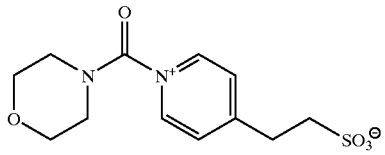
ST-1
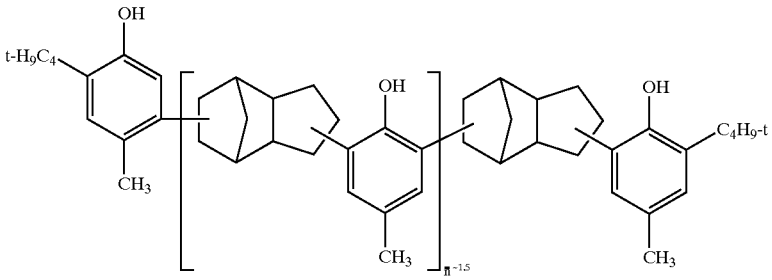
ST-2 1:1 mixture of epoxidised soy oil fatty acid butyl ester with an oxirane oxygen content of 6.1 wt. % and
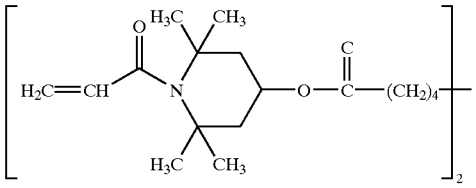
ST-3
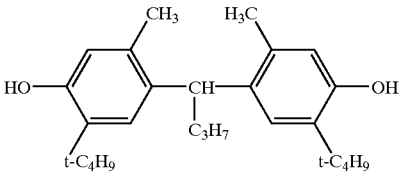
-continued
ST-4
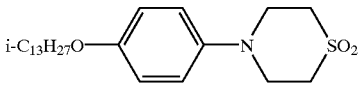
ST-5
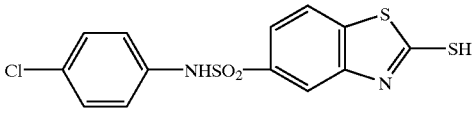
ST-6 epoxidised soy oil fatty acid octyl ester, oxirane oxygen content approx. 5.2 wt. %

GS-1

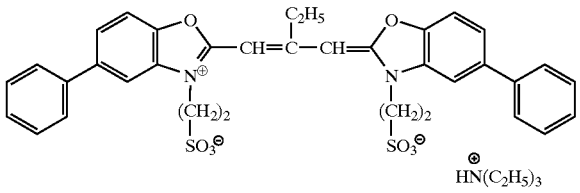

BS-1

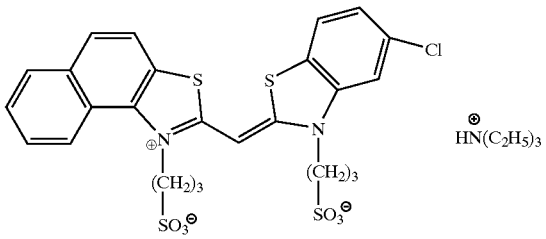

RS-1

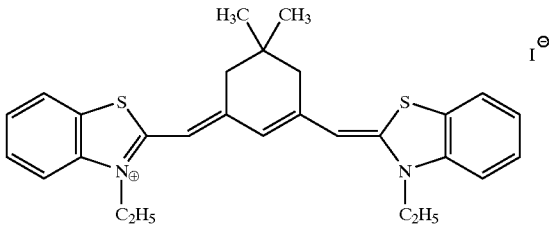

W-1

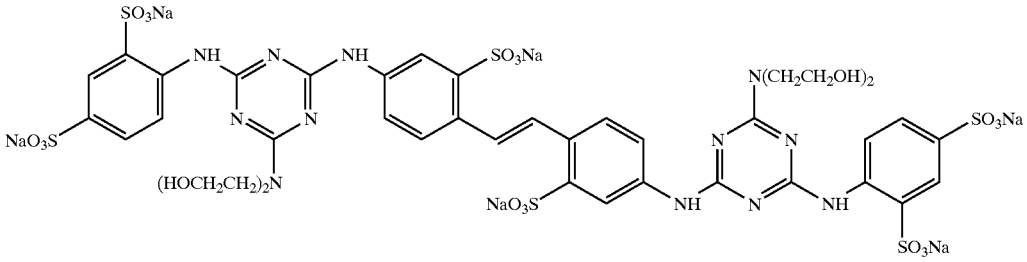

Processing:

Samples of the material are exposed under a grey wedge through a red filter and processed as follows:

| | | |
|---|---|---|
| a) | Colour developer - 45 s - 35° C. | |
| | Triethanolamine | 9.0 g |
| | N,N-Diethylhydroxylamine | 2.0 g |
| | Bis(2-sulfoethyl)hydroxylamine disodium salt | 2.0 g |
| | Diethylene glycol | 0.05 g |
| | 3-Methyl-4-amino-N-ethyl-N-methane-sulfonamidoethylaniline sulfate | 5.0 g |
| | Potassium sulfite | 0.2 g |
| | Triethylene glycol | 0.05 g |
| | Potassium carbonate | 22 g |
| | Potassium hydroxide | 0.4 g |
| | Ethylenediaminetetraacetic acid, disodium salt | 2.2 g |
| | Potassium chloride | 2.5 g |
| | 1,2-Dihydroxybenzene-3,4,6-trisulfonic acid trisodium salt | 0.3 g |
| | make up with water to 1000 ml; pH 10.0 | |
| b) | Bleach/fixing bath - 45 s - 35° C. | |
| | Ammonium thiosulfate | 75 g |
| | Sodium hydrogen sulfite | 13.5 g |
| | Ammonium acetate | 2.0 g |
| | Ethylenediaminetetraacetic acid (iron/ammonium salt) | 57 g |
| | Ammonia, 25% | 9.5 g |
| | make up with acetic acid to 1000 ml; pH 5.5 | |
| c) | Rinsing - 2 min - 33° C. | |
| d) | Drying | |

The percentage yellow and magenta secondary densities were then determined at cyan density $D_{cyan}$=1.0 ($SD_{yellow}$, $SD_{magenta}$). The results are shown in Table 1. The samples are also stored in darkness for 42 days at 85° C. and 60% relative humidity and the percentage reductions in density at maximum density ($\Delta D_{max}$) were determined. Further samples are exposed to $15 \cdot 10^6$ lux·h of light from a daylight-standardised xenon lamp at 35° C. and 85% relative humidity. The reduction in density at D=0.6 is then determined [$\Delta D_{0.6}$].

The following oil formers are also used in the other samples:

OF-1

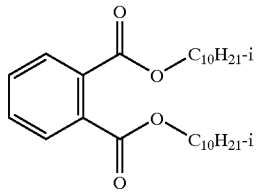

OF-2

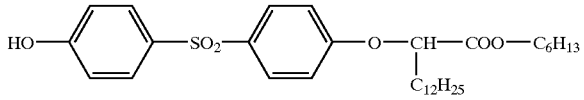

TABLE 1

| Layer structure | Layer 6 Cyan coupler | Layer 6 Oil former | Secondary density (%) $SD_{yel-low}$ | Secondary density (%) $SD_{ma-genta}$ | Dark stability $\Delta D_{max}$ (%) | Light stability (%) $\Delta D_{1.0}$ (%) |
|---|---|---|---|---|---|---|
| 101(C) | C-1/C-2 (1:3) | DBP/TCP (1:1) | 11.8 | 28.3 | 37 | −27 |
| 102(C) | C-4 | DBP/OF-1 (1:1) | 12.7 | 37.9 | 4 | −36 |
| 103(C) | C-13 | TCP/OF-2 (1:3) | 9.9 | 27.8 | −13 | −78 |
| 104(C) | C-17 | DBP/OF-1 (1:1) | 9.6 | 31.4 | −7 | −31 |
| 105(1) | I-2 | DBP/TCP (1:1) | 9.8 | 24.2 | −9 | −32 |
| 106(1) | I-26 | TCP | 9.5 | 25.3 | −7 | −29 |
| 107(1) | I-32 | DBP/TCP (1:1) | 9.9 | 23.7 | −10 | −39 |
| 108(1) | I-33 | TCP/DBP (2:1) | 9.4 | 26.2 | −6 | −31 |
| 109(1) | I-38 | TCP | 9.7 | 27.1 | −10 | −28 |
| 110(1) | I-53 | TCP | 9.3 | 25.8 | −7 | −27 |
| 111(1) | I-56 | TCP/DBP (2:1) | 9.8 | 24.7 | −8 | −32 |
| 112(1) | I-57 | TCP | 9.9 | 26.4 | −11 | −28 |

C: comparison;
I: according to the invention

In comparison with conventional phenolic cyan couplers (C-1 and C-2), conventional diacylaminophenol cyan couplers (C-4), heterocyclic cyan couplers (C-13) and the special diacylaminophenol cyan couplers according to U.S. Pat. No. 5,686,235 (C-17), only the couplers according to the invention yield dyes which are simultaneously distinguished by good light stability, outstanding dark stability and good colour reproduction.

What is claimed is:

1. A color photographic silver halide material which comprises a support and at least one photosensitive silver emulsion layer which is associated with a cyan coupler of the formula (I):

(I)

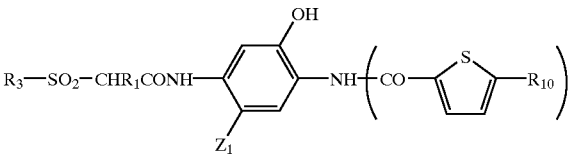

in which $R_1$ is H, alkyl or aryl, $R_3$ is aryl, $Z_1$ is H or a group eliminable under the conditions of chromogenic development, $R_{10}$ is H, Cl, CN, Br, F, alkylcarbonyl, arylcarbonyl, aklyaminocarbonyl, arylaminocarbonyl, alkoxycarbonyl or aryloxycarbonyl.

2. The color photographic silver halide material as claimed in claim 1, wherein $R_1$ is alkyl.

3. The color photographic silver halide material as claimed in claim 1, wherein $R_1$ is aryl.

4. The color photographic silver halide material according to claim 1, wherein the material contains a DOP scavenger of the formula (IV):

(IV)

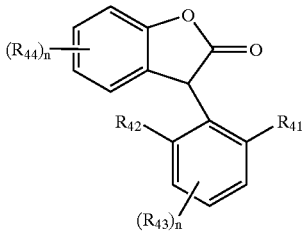

in which $R_{41}$ mutually independently is alkyl, cycloalkyl, aryl, halogen, $SR_{45}$, $NR_{46}R_{47}$, nitro, cyano, $SO_2R_{48}$, $COOR_{49}$, $COR_{50}$, hetaryl or hydrogen, $R_{42}$ has the same meaning as $R_{41}$ or is $OR_{52}$, $R_{43}$ and $R_{44}$ mutually independently is $OR_{51}$ or have the meaning of $R_{41}$, $R_{45}$ and $R_{49}$ mutually independently is alkyl, cycloalkyl, alkenyl, aryl or hetaryl, $R_{46}$ and $R_{47}$ mutually independently is H, $R_{44}$, $COR_{50}$, $COOR_{49}$ or $SO_2R_{48}$, $R_{48}$ and $R_{50}$ mutually independently is alkyl, cycloalkyl, alkenyl, aryl, hetaryl or $NR_{40}R_{47}$, $R_{51}$ is hydrogen, alkyl or aryl, $R_{52}$ is hydrogen, alkyl, aryl, alkylcarbonyl, alkenylcarbonyl, arylcarbonyl, alkoxcarbonyl, alkenyloxycarbonyl, carbamoyl, alkylsulfonyl or aryisulfonyl, o is 0, 1, 2, 3 or 4 and p is 0, 1, 2, or 3, wherein two residues $R_{43}$ and $R_{44}$ may in each case mean a fused carbo- or heterocyclic ring or the compound of the formula (IV) is attached to a polymer chain via a residue $R_{43}$ or $R_{44}$.

5. The color photographic material according to claim 1, wherein the compounds of the formula 1 are used in a quantity of 10 to 1000 mg/m$^2$.

6. The color photographic material according to claim 1, wherein the compounds of the formula 1 are used in a quantity of 20 to 500 mg/m$^2$.

* * * * *

UNITED STATES PATENT AND TRADEMARK OFFICE

CERTIFICATE OF CORRECTION

PATENT NO. : 6,436,623 B1
DATED : August 20, 2002
INVENTOR(S) : Hagemann et al.

It is certified that error appears in the above-identified patent and that said Letters Patent is hereby corrected as shown below:

Column 30,
Line 53, delete “aryisulfonyl” and insert -- arylsulfonyl --.

Signed and Sealed this

Fourth Day of February, 2003

JAMES E. ROGAN
*Director of the United States Patent and Trademark Office*